US007233754B2

(12) United States Patent
Kida

(10) Patent No.: US 7,233,754 B2
(45) Date of Patent: Jun. 19, 2007

(54) IMAGE FORMING SYSTEM AND IMAGE FORMING APPARATUS BEING CONFIGURED FOR EASY REMOVAL OF JAMMED RECORDING MATERIAL AND FOR REDUCING INSTALLATION SPACE

(75) Inventor: Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 444 days.

(21) Appl. No.: 10/684,264

(22) Filed: Oct. 10, 2003

(65) Prior Publication Data

US 2004/0126161 A1 Jul. 1, 2004

(30) Foreign Application Priority Data

Oct. 11, 2002 (JP) ..... 2002-299564

(51) Int. Cl.
*G03G 21/16* (2006.01)

(52) U.S. Cl. ..... 399/124

(58) Field of Classification Search ..... 399/16, 399/21, 23, 107, 110, 124, 391, 407
See application file for complete search history.

(56) References Cited

U.S. PATENT DOCUMENTS 5,253,028 A * 10/1993 Gonda et al. ..... 399/124
5,839,032 A 11/1998 Yasui et al.
5,995,773 A * 11/1999 Awano ..... 399/21
6,876,830 B2 * 4/2005 Ohgita et al. ..... 399/124

FOREIGN PATENT DOCUMENTS

JP 07-301964 11/1995

* cited by examiner

*Primary Examiner*—Hoan Tran
(74) *Attorney, Agent, or Firm*—David G. Conlin; William J. Daley, Jr.; Edwards Angell Palmer & Dodge LLP

(57) ABSTRACT

An image forming apparatus includes an image recording device and a recording material supply device, and an external recording material supply device is connected to the recording material supply device in parallel. In a main body of the recording material supply device, a space is formed between the inner wall on a peripheral equipment connecting side and a longitudinal transport path so as to allow the longitudinal transport path to open from a front side of the recording material supply device. The longitudinal transport path is provided for transporting the recording material from the recording material supply device to the image recording device.

19 Claims, 13 Drawing Sheets

IMAGE FORMING SYSTEM AND IMAGE FORMING APPARATUS BEING CONFIGURED FOR EASY REMOVAL OF JAMMED RECORDING MATERIAL AND FOR REDUCING INSTALLATION SPACE

FIELD OF THE INVENTION

The present invention relates to an image forming system which permits functions to be expanded according to an environment, and an image forming apparatus adopted in such system, and more particularly relates to an image forming system wherein a copying machine, a printer or other image forming apparatus is connected to a recording material supply device or other peripheral equipment in parallel to the side face of a main body of the image forming apparatus, and an image forming apparatus to be adopted in such image forming system.

BACKGROUND OF THE INVENTION

In these years, image forming systems have been developed, wherein functions can be expanded by combining the image forming apparatuses with a peripheral equipment(s) as user desires or to be adjusted to the environment of use.

In recent years, image forming apparatuses such as digital copying machines are more and more digitalized, and such image forming apparatuses used in offices are often connected to network as with a variety of terminal equipments. Under such environment of use, to be capable of processing a large volume of image data, a large capacity feeder unit (recording material supply device) as a peripheral equipment is often combined with an image forming apparatus such as copying machine, a printer, etc.

Such image forming apparatus is, for example, made up of an image forming section, a scanner, a feeder section, etc., (see Japanese Unexamined Patent Application No. 9-297440/1997 (Tokukaihei 9-297440), published on Nov. 18, 1997 (U.S. Pat. No. 5,839,032)).

As illustrated in FIG. 11, Japanese Unexamined Patent Application No. 9-297440/1997 discloses an image forming apparatus including a main body unit 110, and a scanner 120 as a scanner section separately provided from the main body unit 110.

This main body unit 110 is made up of an image forming section 130 for forming an image and a feeder 140 as a feeding section, provided below the image forming section 130, for transporting a recording material to the image forming section 130. The feeder 140 includes a plurality of feed cassettes 141, and is arranged so as to feed a recording material to the image forming section 130 from either one of the plurality of feed cassettes 141 through a transport path 142.

In the image forming apparatus of the foregoing structure, in an event that a paper jam occurs in the transport path 142, the user needs to check the position of the paper jam with his/her eyes, and remove the jammed recording material.

To allow the user to perform the foregoing operation of removing the jammed recording material, the image forming apparatus is generally provided with an opening for allowing the transport path to open on the side face of an image forming apparatus main body. With this structure, when a paper jam occurs, the user opens this opening on the side face to remove the paper stuck in the transport path.

As illustrated in FIG. 11, in the image forming apparatus, a side cover 150, which is an opening for allowing the transport path 142 to open for removing a jammed recording material is formed on the side face of the image forming section 130 on the side face of the main body unit 110. The side cover 150 can be opened and closed by rotating about an axis 151 provided below the side cover 150.

The image forming apparatus is also provided with a both-sided unit 160 outside the side cover 150 on the main body unit 110. This both-sided unit 160 is provided for transporting a recording material having recorded thereon an image to the main body unit 110 again by reversing the recording material by a switch back. For this reason, as illustrated in FIG. 12, the image forming apparatus is arranged so as to open the transport path 142 by moving the side cover 150 downwards to the position indicated by a solid line from the position indicated by a chain double-dashed line in the state where both-sided unit 160 is detached from the side cover 150 using the axis 161 provided below the both-sided unit 160 as a fulcrum.

Although not shown in Japanese Unexamined Patent Application No. 9-297440/1997 (Tokukaihei 9-297440), according to the feeder 140, in consideration of such event that a recording material is jammed in a common transport path which extends in a longitudinal direction for transporting the recording material as fed from either one of the plurality of feed cassettes 141 of the feeder 140, the structure which allows the transport path to open is needed.

Such structure of allowing the transport path to open will be explained through an example of FIG. 13 (see, for example, Japanese Unexamined Patent Application No. 7-301964/1995 (Tokukaihei 7-301964) published on Nov. 14, 1995).

As illustrated in FIG. 13, Japanese Unexamined Patent Application No. 7-301964/1995 discloses an image forming apparatus, which is provided with a plurality of feed trays 203 in the feed unit 202 below the main body unit 201.

The image forming apparatus is provided with a common transport path 204 for transporting a recording material P as fed from the feed tray 203 to the main body unit 201. According to the image forming apparatus, by opening a guide cover 205 provided on the side face of the feeder unit 202 in a direction crossing the recording material transport direction Z at right angle, it is possible to remove a recording material P stuck in the transport path 204.

According to the image forming apparatus of the Japanese Unexamined Patent Application No. 9-297440/1997, and Japanese Unexamined Patent Application No. 7-301964/1995, it is possible to check the recording material and remove it from the transport path only by opening the transport path, which extends in the longitudinal direction from the side face of the image forming apparatus.

However, with the structure of the image forming apparatus wherein the transport path which extends in the longitudinal direction is provided on the side face of the image forming apparatus, it is difficult to connect a peripheral equipment for system-up to the image forming apparatus on the side of the transport path as in the image forming apparatuses of the Japanese Unexamined Patent Application No. 9-297440/1997 and Japanese Unexamined Patent Application No. 7-301964/1995 (Tokukaihei 7-301964).

Specifically, for example, in the case where a large volume feeder unit capable of storing a plurality of recording materials in a plurality of feeder cassettes is connected in parallel to the transport path in the image forming apparatus, it is necessary to move the large volume feeder unit each time the transport path is opened.

In this case, a problem arises in that it is difficult to move the feeder unit to be apart from the side face of the image forming apparatus in an efficient manner, as the feeder unit storing a large volume recording material is very heavy. Besides, to move the large volume feeder unit to be apart from the side face of the image forming apparatus, it is necessary to install the image forming apparatus and the feeder unit in consideration of the operation space for such movement, and the selection for the installation spaces of the image forming apparatus are therefore limited. The latter problem is not a particular problem for the case of adopting the large volume feeder unit as the peripheral equipment of the image forming apparatus, and such problem arises when connecting any of a peripheral equipment in parallel to the side of the transport path for system-up of the image forming apparatus of the foregoing structure.

In order to overcome the foregoing problem, the feeder unit may be connected in parallel to the image forming apparatus on an opposite side of the common transport path. In this case, however, it is necessary to provide a new transport path, which extends to the common transport path from the side face on the opposite side of the common transport path in the image forming apparatus, which results in a longer transport path. As a result, a longer time is needed to print out one sheet, and a transporting error of the recording material is liable to occur.

SUMMARY OF THE INVENTION

It is an object of the present invention to provide an image forming apparatus and an image forming system including a peripheral equipment connected to the image forming apparatus in parallel to a side wall of the main body of the image forming apparatus which permits an operation of removing a jammed recording material to be performed efficiently and an installation space of the peripheral equipment and a necessary space for such process to be minimized, and an image forming apparatus suitably adopted for such system.

In order to achieve the foregoing object, an image forming system of the present invention is characterized by including:

an image forming apparatus which includes:

a recording material supply path (a longitudinal transport path, for example) for supplying a recording material in a substantially vertical direction from a recording material storage section (a recording material supply device, for example) towards an image forming section (an image recording device, for example) for forming an image on the recording material, wherein the recording material transport path is provided in the image forming apparatus along one of side walls of a main body of the image forming apparatus; and a peripheral equipment (an external recording material supply device of a large volume supply unit, example) to be connected to the image forming apparatus in parallel to the side wall on a side of the recording material supply path in the main body of the image forming apparatus, and wherein the main body of the image forming apparatus (a main body of the recording material supply device, for example) has a space which allows the recording material supply path to open from a front side of the image forming apparatus, the space being formed between an inner side wall on a connecting side of the peripheral equipment and the recording material supply path.

According to the foregoing structure, an operation of opening the recording material supply path can be performed using the space formed in the main body, and it is therefore possible to perform the process of removing a jammed recording material without moving the peripheral equipment. As a result, the process of removing the jammed recording material can be performed with an improved efficiency. In the meantime, the image forming system can be installed without considering the space for the operation of removing the jammed recording material, and the installation space and the operation space can be reduced. Thus, the installation space can be ensured with ease. As a result, it is possible to provide an image forming system, which shows an excellent operation efficiency in removing a jammed recording material while reducing the installation space for the peripheral equipment and the required space for removing the jammed recording material.

It is desirable that the foregoing image forming system be further arranged so as to include a recording material re-transport path for reversing a recording material having formed thereon an image and transporting the recording material again to the image forming section; and the recording material supply path and the recording material re-transport path are provided in such a manner that the space is formed below the recording material re-transport path in the main body of the image forming apparatus.

According to the foregoing structure, the above space can be formed using a space formed under the recording material re-transport path. It is therefore possible to minimize the installation space for the image forming apparatus, which, in turn, minimizes the installation space for the image forming system. In the meantime, a simple and neat design for the image forming apparatus can be realized, which in turn realizes an overall image forming system of simple and neat design.

It is preferable that the foregoing image forming system be further arranged such that the recording material re-transport path be provided along an inner side wall of the main body of the image forming apparatus on a side of the recording material supply path, and the recording material re-transport path can be opened at above the peripheral equipment.

According to the foregoing structure, it is possible to remove the recording material as stuck in the recording material re-transport path within the range for the width of the installation place of the image forming system. In the meantime, it is possible to install the peripheral equipment with a minimum installation space and to open the recording material re-transport path, etc.

It is also preferable that the foregoing image forming system be arranged such that:

the peripheral equipment is a recording material supply device for supplying a recording material from outside the image forming apparatus to the image forming section; and the recording material supply device (an external recording material supply device such as a large volume feeder unit, for example) has an expanded recording material storage section which can be drawn to the front side.

According to the foregoing structure, it is not necessarily to ensure the space for supplying and exchanging the recording material with respect to the recording material supply device, and the recording material can be supplied to the recording material supply device or exchanged from those stored in the recording material supply device within a predetermined width of the image forming apparatus. It is therefore possible to minimize the installation space and the operation space. In the meantime, it is possible to expand the functions of the apparatus while suppressing the required space for installation of the peripheral equipment, and thus the installation space can be ensured with ease. Furthermore, the foregoing operation can be performed from the front side of the image forming system, and thus a still improved operability can be achieved.

It is desirable that the foregoing image forming system be further arranged such that:

the space is formed in sufficient size to allow the recording material supply path to open in such a manner that an operation of removing the recording material stuck in the recording material supply path can be performed.

It is desirable that the foregoing image forming system be further arranged such that:

the recording material supply path includes a guide section which forms the space; and the guide section is supported so as to be rotatable about an axis provided at a bottom end of the recording material supply path, so that the guide section can be moved to the space.

It is also preferable that the foregoing image forming system be further arranged such that the main body of the image forming apparatus has a cover on a front side of the main body of the image forming apparatus, which opens and closes the space as desired.

According to the foregoing structure, in such event that a recording material is jammed in the recording material supply path, the user can confirm the recording material in the state where the recording material supply path is open, and can then remove the recording material as stuck.

It is desirable that the foregoing image forming system be further arranged such that a height of an upper surface of the peripheral equipment is selected so as to allow a predetermined unit of the image forming apparatus to draw at above the peripheral equipment.

It is desirable that the foregoing image forming system be arranged such that the predetermined unit includes a both-sided printing transport device, which has the recording material re-transport path.

It is desirable that the foregoing image forming apparatus be arranged such that the recording material supply section can be drawn to a front side; and not only an operation of the image forming apparatus but also an operation of the peripheral equipment can be performed from a front side of the image forming system.

In order to achieve the above object, an image forming apparatus of the present invention is characterized by including:

a recording material supply path for supplying a recording material in a substantially vertical direction from a recording material storage section towards an image forming section for forming an image on the recording material, wherein the recording material transport path is provided in the image forming apparatus along one of side walls of a main body of the image forming apparatus;

the main body of the image forming apparatus has a space which allows the recording material supply path to open from a front side of the image forming apparatus, the space being formed between an inner wall on a side of the recording material supply path and the recording material supply path; and the space is formed in sufficient size to allow the recording material supply path to open in such a manner that an operation of removing the recording material stuck in the recording material supply path can be performed.

According to the foregoing structure, the process of removing the recording material as stuck in the recording material supply path can be performed from the front side of the image forming apparatus. In the meantime, the image forming system can be installed without considering the space for the operation of removing the jammed recording material, and the installation space and the operation space can be reduced. Thus, the installation space can be ensured with ease. With the foregoing structure, it is therefore possible to perform various operations as desired even when the image forming apparatus is installed at a corner of the room.

In order to achieve the above object, an image forming apparatus connectable to a peripheral equipment, is characterized by including:

a recording material supply path for supplying a recording material in a substantially vertical direction from a recording material storage section towards an image forming section for forming an image on the recording material, wherein the recording material transport path is provided in the image forming apparatus along one of side walls of a main body of the image forming apparatus; and the main body of the image forming apparatus has a space which allows the recording material supply path to open from a front side of the image forming apparatus, the space being formed between an inner side wall on a peripheral equipment connecting side and the recording material supply path.

According to the foregoing structure, an operation of opening the recording material supply path can be performed using the space formed in the main body, and it is therefore possible to perform the process of removing a jammed recording material without moving the peripheral equipment connected to the image forming apparatus. As a result, the process of removing the jammed recording material can be performed with an improved efficiency. In the meantime, the image forming system can be installed without considering the space for the operation of removing the jammed recording material, and the installation space and the operation space can be reduced. Thus, the installation space can be ensured with ease. As a result, it is possible to provide an image forming system and an image forming system suitably adopted in the image forming system which show an excellent operation efficiency for removing a jammed recording material while reducing the installation space for the peripheral equipment and the required space for removing the jammed recording material.

For a fuller understanding of the nature and advantages of the invention, reference should be made to the ensuing detailed description taken in conjunction with the accompanying drawings.

DESCRIPTION OF THE EMBODIMENTS

First Embodiment

The following descriptions will explain one embodiment of the present invention in reference to FIGS. 1 to 10.

Figure 1:
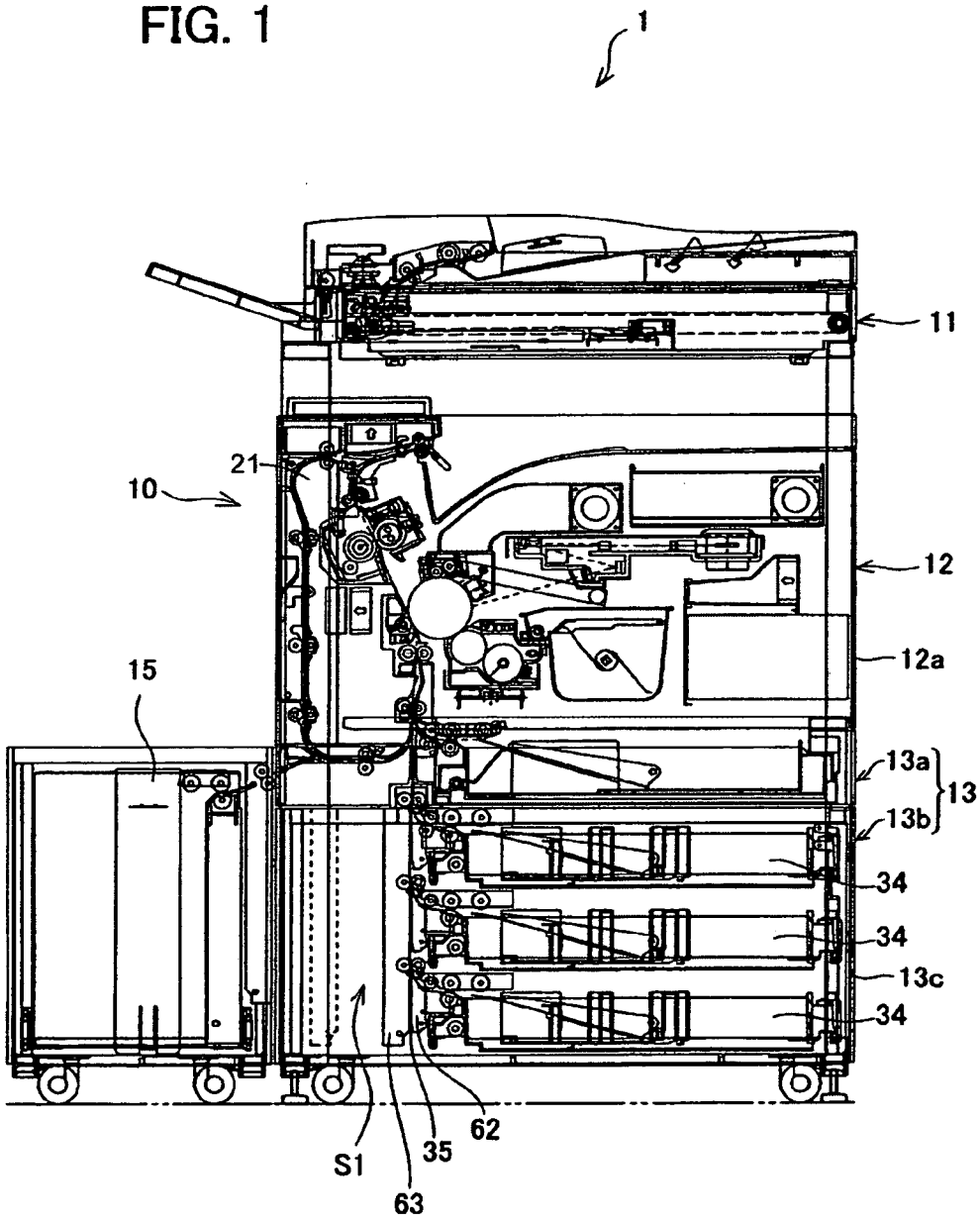
FIG. 1 is cross-sectional view illustrating the structure of an image forming system in accordance with one embodiment of the present invention.

As illustrated in FIG. 1, an image forming system 1 in accordance with the present embodiment includes an image forming apparatus 10 and an external recording material supply unit (peripheral equipment) 15 connected to the image forming apparatus 10 in parallel.

The image forming apparatus 10 includes an image recording device (image forming section) 12, and a recording material supply section 13, and forms an image on a recording material (sheet or the like) to be functioned as a copying machine, a printer, etc. The image forming apparatus 10 shown in FIG. 1 is provided with a recording material supply section 13 which is made up of a recording material supply unit 13*a*, and a recording material supply device (recording material storage section) 13*b* as an expanded unit in the image recording device main body (cabinet) 12*a* of the image recording device 12.

The image forming apparatus 10 further includes a document image reading device (image reading device) of FIG. 1 as an image reading section to be functioned as a digital copying machine, a facsimile machine, etc.

Figure 2:
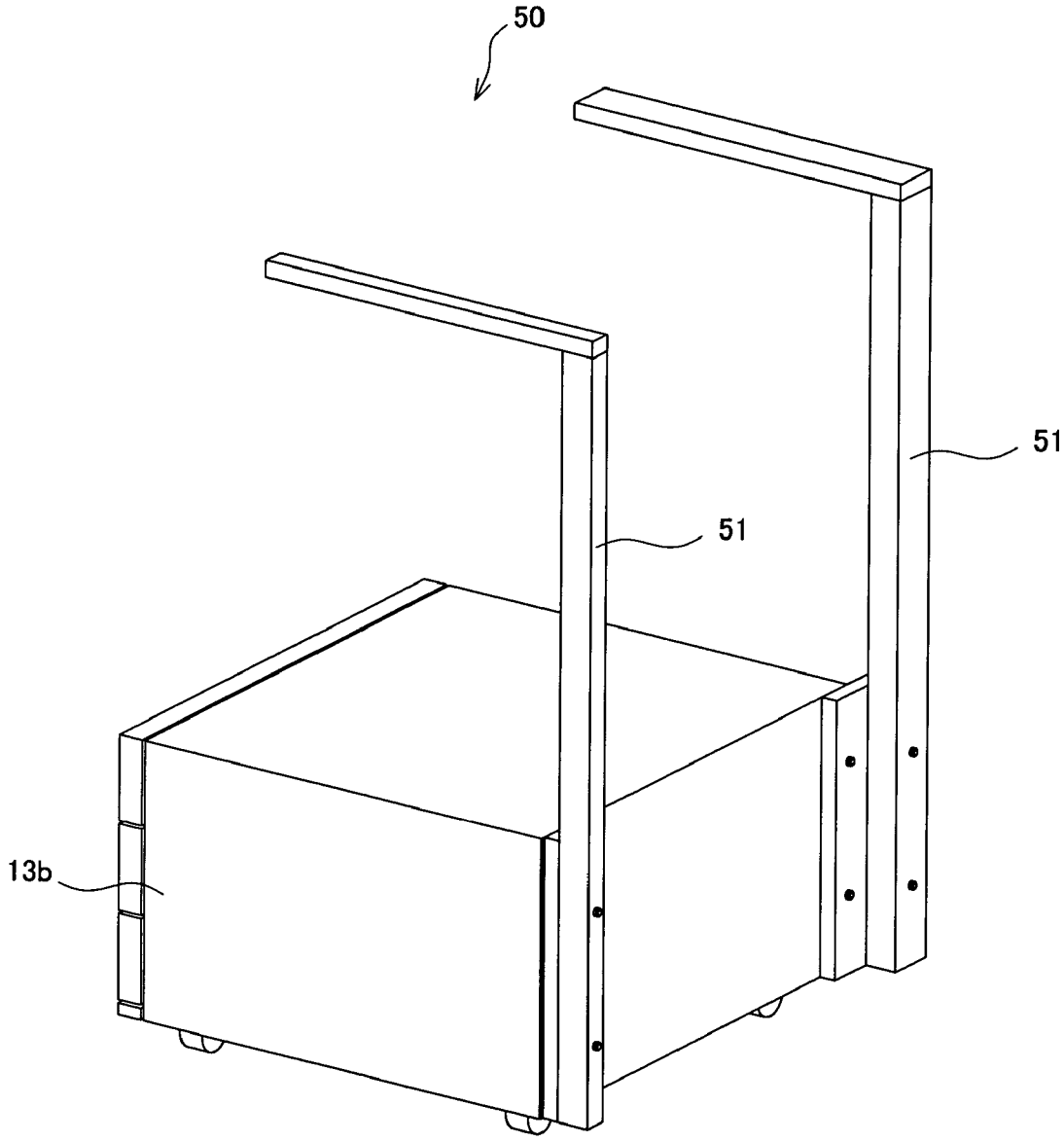
FIG. 2 is a perspective view illustrating the structure of a document image reading device support member adopted in an image forming apparatus of the image forming system when seen from the back.

As illustrated in FIG. 2, a document image reading device 11 is mounted on and supported by a support frame 51 of a document image reading device support member 50 at above the document image reading device support member 50. The document image reading device support member 50 is fixed with the recording material supply device 13*b* on the back surface of the recording material supply device 13*b* shown in FIG. 2. The document image reading device 11 is mounted to and supported by the upper surface of the support member 50. Further, the this document image reading device support member 50 stores the image recording device 12 in a space formed in the lower space, i.e., in the space formed between the recording material supply device 13*b* and the document image reading device 11. In the present embodiment, the recording material supply device 13*b* is a unit which has a disk function for mounting the image recording device 12, and is connectable to the image recording device 12.

As described, according to the present embodiment, by adopting the document image reading device support member 50, the document image reading device 11, the image recording device 12 and the recording material supply device 13*b* can be integrated in the image forming apparatus 10, and all the process from inputting a document image (reading) to outputting an image (printing out) can be performed in one image forming apparatus 10.

As described, by adopting the document image reading device support member 50, the image reading device 12 and the document image reading device 11 can be connected within an installation space for the recording material support device 13*b*, and it is therefore possible to minimize the installation space.

In the following, respective devices, which constitute the image forming apparatus 10 and essential parts thereof will be explained in details.

Figure 3:
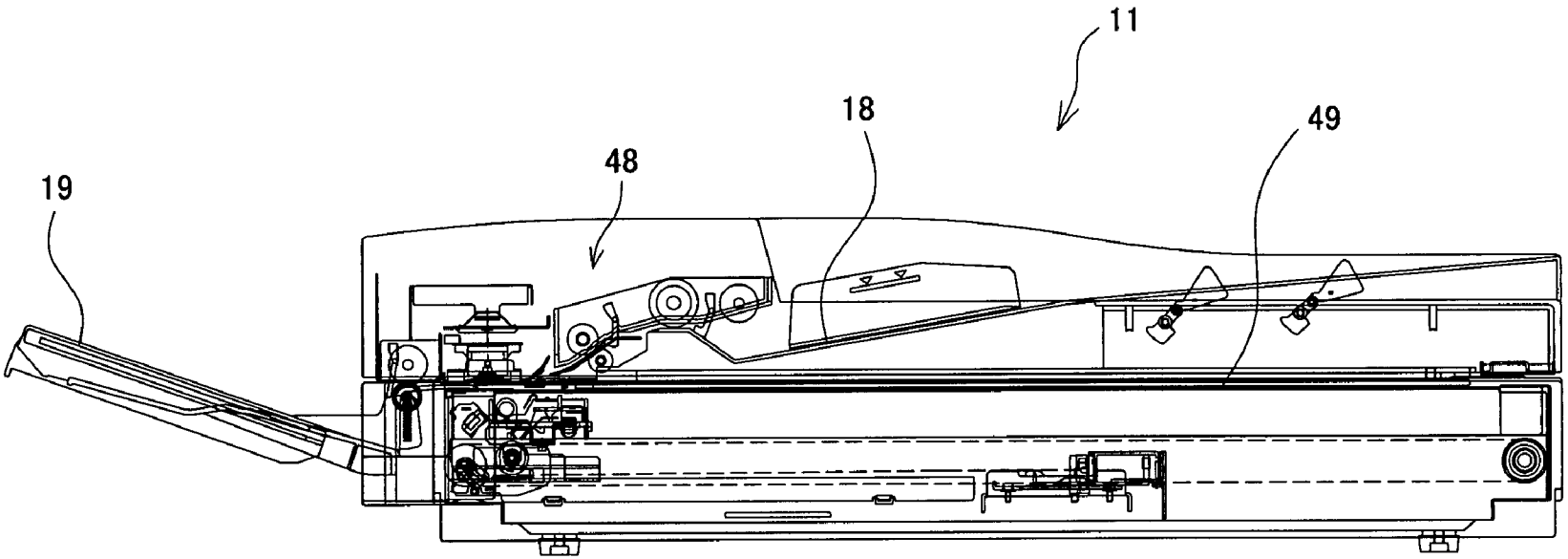
FIG. 3 is a cross-sectional view illustrating the structure of a document image reading device in the image forming apparatus.

FIG. 3 is a cross-sectional view illustrating the structure of the document image reading device 11. The document image reading device 11 forms an image on a charge coupled device (CCD) by exposure scanning a document image set on a transparent document reading platen 49 as a reading section, and outputs the document image as an image data after converting the document image into an electric signal. The image data thus obtained is output via the connecting section with the image reading device 12.

The document image reading device 11 can be set in an automatic reading mode or a manual reading mode, and the document is set on the document reading platen 49 according to the set mode, i.e., automatically or manually.

In the automatic reading mode, document sheets are automatically fed one by one by an automatic document feeder (hereinafter referred to as ADF) 48 to read out the document image by carrying out an exposure scanning sequentially. In the manual mode, on the other hand, a document in a form of book or sheet, which cannot be fed automatically by the ADF 48 is set manually for reading therefrom a document image.

The document image reading device 11 is provided with a document tray (document supply section) 18 and a discharge tray 19. Upon placing the document on the document tray 18 before being read, the document reading section of the ADF 48 reads the document, and the document as read is transported to the document reading point (reading section) in the document transport path. The document as read at the document reading point is discharged outside the device by the document discharge section, and is discharged onto a discharge tray.

The document image reading device 11 is capable of reading a document image by scanning from under and above the document simultaneously in the process of transporting a document along a document transport path by an automatic document feeder (hereinafter referred to as ADF).

When reading an image on the bottom surface of the document, a movable scanning exposure optical system which scans the bottom surface of the document reading platen 49 leads an optical image to a photoelectric transfer element at its stoppage at a predetermined position in the document transport path.

An image formed on the upper surface of the document can be read by the structure wherein a close image sensor (CIS), which is integrally made up of a light source for exposing the document, an optical lens which leads an optical image to a photoelectric transfer element, and the photoelectric transfer element for converting an optical image into image data, is provided above the document transport path in the ADF 48, and upon selecting the both-sided mode for reading images formed on both sides of the document, the document as set on the document tray 18 is sequentially transported, and the images on both sides of the document as being transported are read substantially at the same time.

Figure 4:
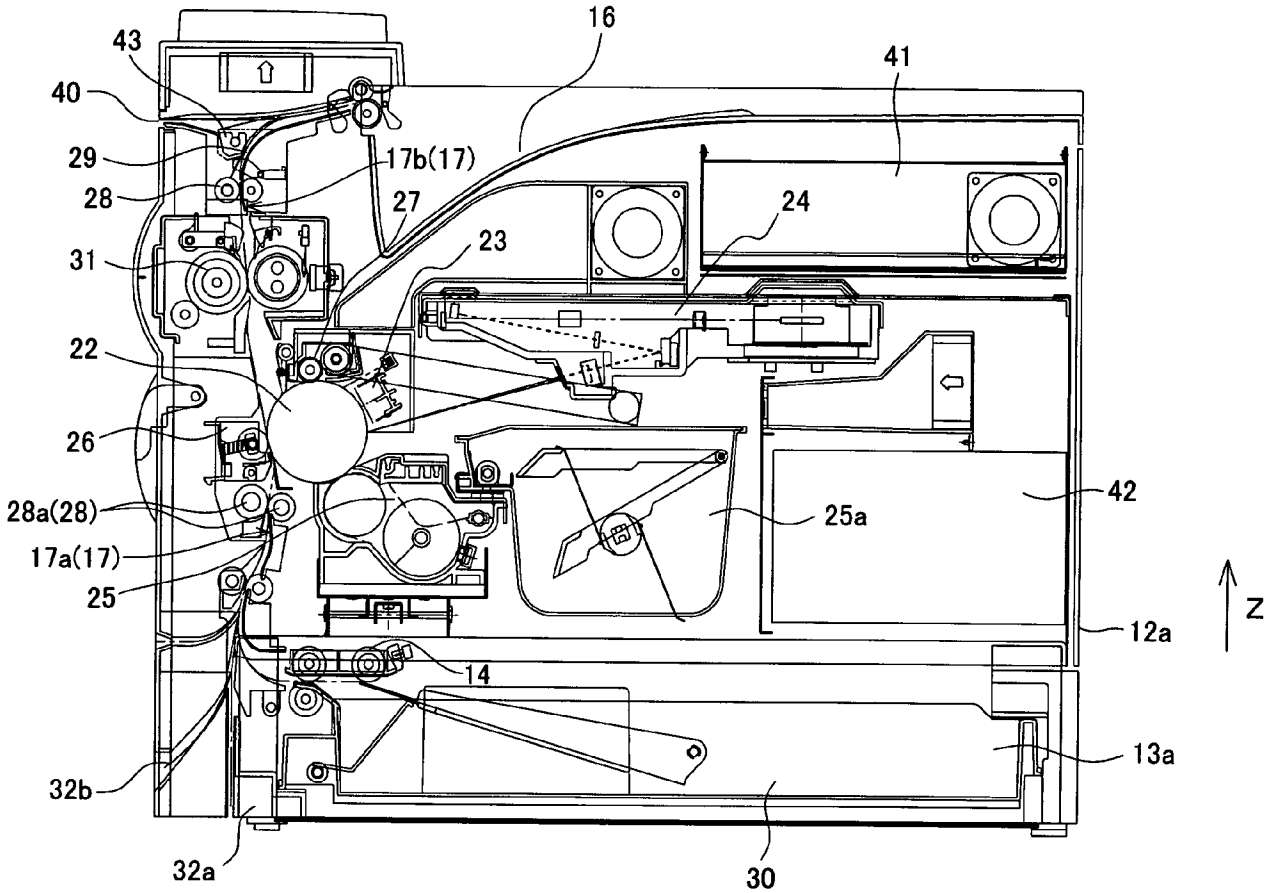
FIG. 4 is a cross-sectional view illustrating the structure of essential parts of an image recording device of the image forming apparatus.

FIG. 4 is a cross-sectional view illustrating the structure of essential parts of the image recording device 12. The image recording device 12 records on a recording material i) image data as input by an external apparatus such as a personal computer (image processing device) not shown connected to the document image reading device 11 or the image recording device 12 or ii) image data such as FAX data as being transmitted by communication equipment.

The image recording device 12 is provided with an electro-photographic processing section on the left part around the center. The electro-photographic processing section is made up of a photoreceptor drum 22, and along a circumference of the photoreceptor drum 22, a charger unit 23, an optical scanning unit 24, a developer unit 25, a transfer unit 26, a cleaning unit 27, etc., as process units having respective functions in the image forming process.

The charger unit 23 is provided for uniformly charging the surface of the photoreceptor drum 22. The optical scanning unit 24 is provided for writing an electrostatic latent image on the photoreceptor drum 22, which is charged uniformly by scanning an optical image. The developer unit 25 then visualizes the resulting static latent image written by the optical scanning unit by a developer agent supplied from a developer supply section 25*a*. The transfer unit 26 transfers the image visualized on the surface of the photoreceptor drum 22 onto the recording material. The cleaning unit 27 enables a new image to be recorded on the photoreceptor drum 22 by removing the developer agent remaining on the surface of the photoreceptor drum 22. The residual developer agent as removed by the cleaning unit 27 is collected into the developer supply section 25*a* of the developer unit 25 for reutilization.

In the upper part of the electro-photographic processing section, provided is a fixing unit 31 which sequentially receives recording materials having transferred thereon images by the transfer unit, and receives recording materials having images transferred thereon by the transfer unit 26, and fixes the developer agent transferred onto the developer agent by applying heat. The recording material having an image printed thereon is discharged from a recording material discharge section 16 in the upper part of the image recording device 12 in the face-down state with a print face faced down.

On the other hand, under the image recording device 12, i.e., in the lower part of the electro-photographic processing section, a recording material storage tray 30 in the recording material supply unit 13*a* is provided in the image recording device main body 12*a*. The recording material stored in the recording material storage tray 30 is separated one by one by the pickup roller 14, etc., provided in the recording material supply section 13, and is transferred to the resist rollers 28*a* in a recording material transport section (recording material transport path) 17. Then, a timing with the image formed on the photoreceptor drum 22 is counted by the resist rollers 28*a*, and is sequentially supplied between the transfer unit 26 and the photoreceptor drum 22. As a result, the image recorded on the photoreceptor drum 22 is transferred onto the recording material.

The recording material transport section 17 includes a plurality of rollers (transport rollers) 28 and the guide 29. The recording material supplied through the first transport path 17a regulated between a plurality of rollers 28 including the resist rollers 28*a*, guides 29, the photoreceptor drum 22 and the transfer unit 26 provided between the recording material supply section 13 and the electro-photographic processing section. After having the image transferred by the transfer unit 26, on the downstream side of the electro-photographic processing section, i.e., in the upper part of the electro-photographic processing section, the recording material is discharged onto the recording material discharge section 16 through the second transport path 17*b* formed as being regulated between the plurality of rollers 28, the guides 29 and the fixing units 31 on the downstream side of the electro-photographic processing section, i.e., in the upper part of the electro-photographic processing section.

The recording material can be supplied to the recording material storage tray 30 or exchanged from the recording material stored in the recording material storage tray 30 from the front side (operating side) of the image recording device 12, i.e., by drawing the recording material storage tray 30 in the direction crossing the recording material transport direction Z at right angle.

On the bottom surface of the image recording device 12 on the left hand side, provided is a recording material receiving section 32*a* for sequentially receiving the recording material transported from the recording material supply device 13*b* as an expanded unit. On the left side wall of the image recording device main body 12*a*, i.e., on the side wall on the side of the external recording material supply unit 15 in the image recording device 12, at a lower section, provided is an expanded recording material receiving section 32*b* which receives the recording material supplied from the external recording material supply unit 15 or a both-sided printing transport unit 21 and which sequentially supplies the recording material between the photoreceptor drum 22 and the transfer unit 26.

Further, in the space around the optical scanning unit 24, provided are the control section 41, the power supply unit 42, etc. The control section 41 includes a process control unit (PCU) substrate for controlling the electro-photographic processing section, the interface substrate for receiving the image data from the external apparatus such as the personal computer, etc., and an image control unit (ICU) for recording the image by scanning by the optical scanning unit 24 after applying a predetermined image process onto the image data as received from the interface substrate the image data as read by the document image recording device 11. The power supply unit 42 is provided for supplying power to the foregoing substrates and various process units.

In the present embodiment, the image forming apparatus 10 includes the document image reading device 11. The present embodiment is not intended to be limited to the document image reading device 11. For example, it may be arranged such that the image recording device 12 alone is connected to the external apparatus such as a personal computer, etc., via the interface substrate to be functioned as a printer for forming the image data from the external apparatus transferred onto the recording material.

Figure 5:
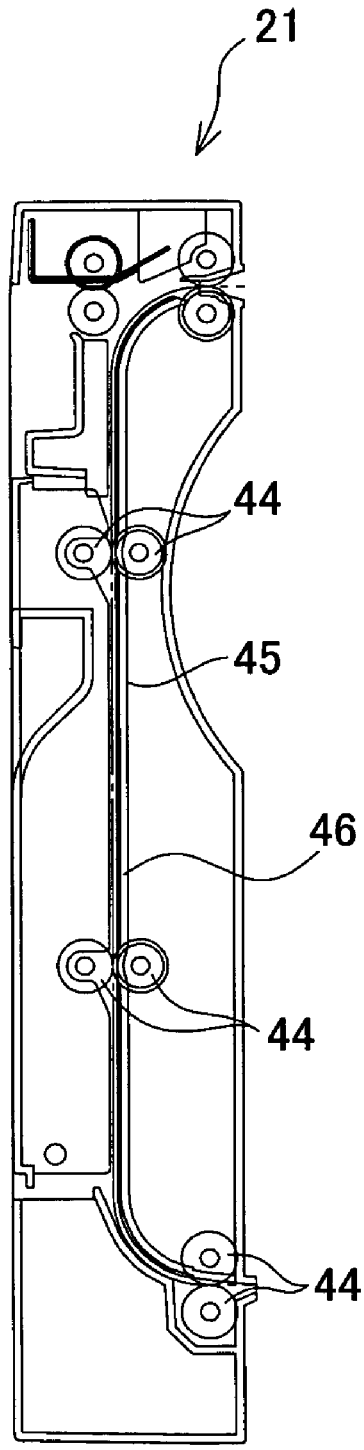
FIG. 5 is a cross-sectional view illustrating the structure of a both-sided printing transport device provided in the image recording device.

As illustrated in FIG. 1, the both-sided printing transport unit (recording material re-transport supply section) 21 is mounted to the left side of the electro-photographic processing section, i.e., on the left side of the image recording device 12. The both-sided printing transport unit 21 is provided for once transporting the recording material having the image formed on one side in the image processing section to the electro-photographic processing section again to form the image on the back surface of the recording material. FIG. 1 shows the structure wherein the both-sided printing transport unit 21 is mounted to the image recording device 12. FIG. 4 shows the structure wherein the both-sided printing transport unit 21 is detached. FIG. 5 shows a cross-sectional view illustrating the structure of the both-sided printing transport unit 21.

As described, in the case where one-sided printing is selected as a print mode of the image recording device 12, the recording material having the image formed thereon is discharged directly outside the image recording device main body 12*a* through the second transport path 17*b*, i.e., to the recording material discharge section 16 provided outside the image recording device 12. On the other hand, in the case where the both-sided printing is set in the print mode of the image recording device 12, by once switch-back transporting the recording material having the image formed thereon as being reversed using the recording material discharge section 16, the recording material is transported again between the photoreceptor drum 22 and the transfer unit 26 in the electro-photographic processing section.

In the case where the both-sided printing is performed as in the foregoing case, or a post processing mode is selected, in which a post processing device which performs a predetermined process after printing (punching, stapling, sorting, etc.,) is provided as a peripheral equipment of the image forming apparatus 10, the recording material transported to the recording material discharge section 16 is not discharged onto the recording material discharge section 16 completely, and the reverse rollers 28*b* having the recording material, which are provided in front of the recording material discharge section 16, are rotated in the reverse direction and further the guide switch 43 is moved from the position indicated by the solid line to the position indicated by the chain double dashed line, whereby the recording material having the image formed thereon can be once guided to the switch gate 40 which leads to the both-sided printing transport unit 21 or the post processing device as necessary.

The both-sided printing transport unit 21 includes a both-sided printing transport section having a plurality of rollers (transport rollers) 44 and guides 45. The recording material supplied to the both-sided printing transport unit 21 is transported again to the first transport path 17*a* from the expanded recording material receiving section 32*a* via a re-transport path (recording material re-transport path) 46 formed as being regulated between the rollers 44 and the guides 45. As a result, the recording material is supplied again to the electro-photographic printing section.

Figure 9:
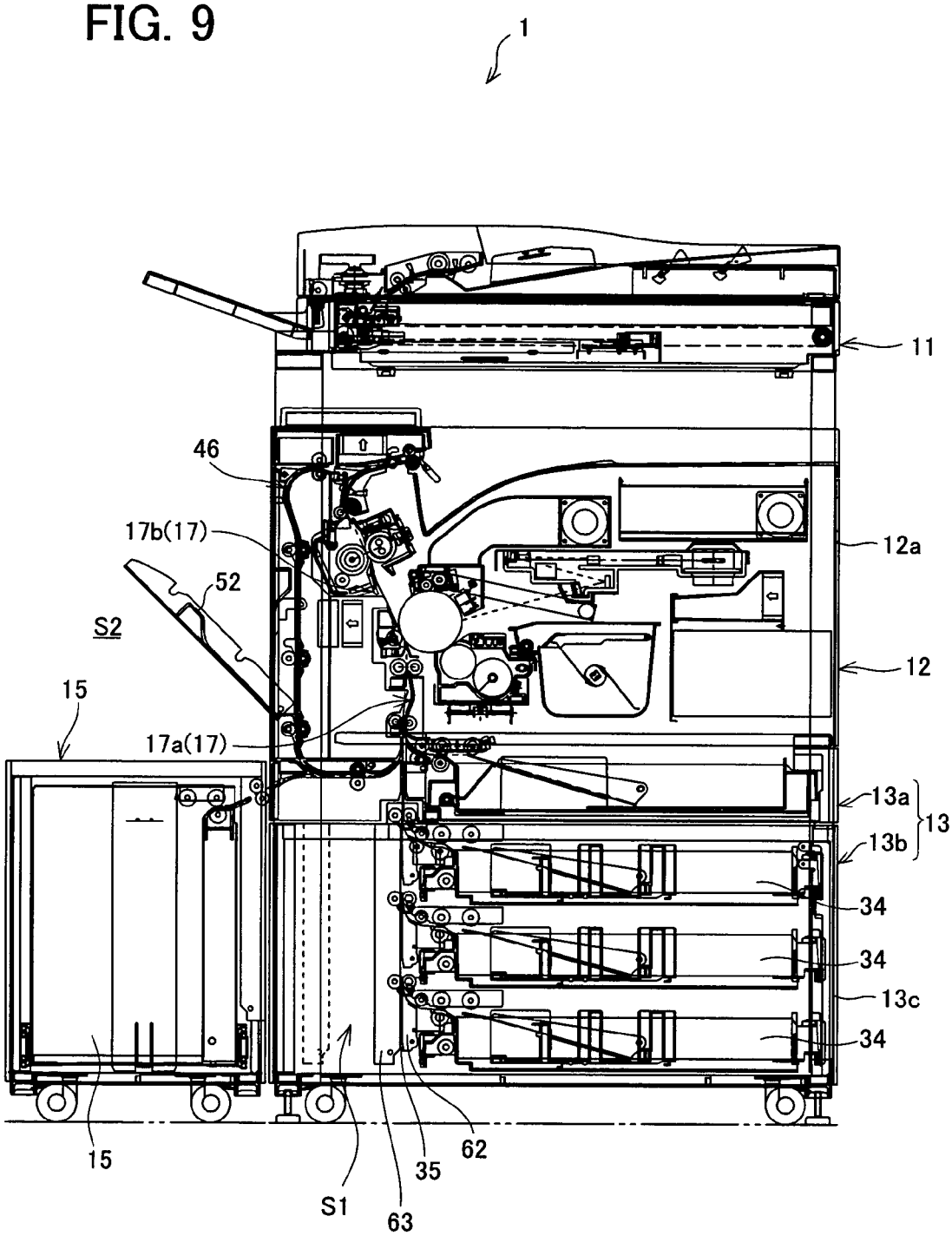
FIG. 9 is a cross-sectional view of the image forming system in the state where a re-transport path of the both-sided printing transport device of FIG. 5 is open.

The re-transport path 46 is provided along the inner wall of the image recording device main body 12*a* on the side of the recording material transport section 17. As illustrated in FIG. 9, the re-transport path 46 can be opened by opening the left side face of the both-sided printing transport unit 21, i.e., the side face on the side facing outside of the both-sided printing transport unit 21.

Figure 6:
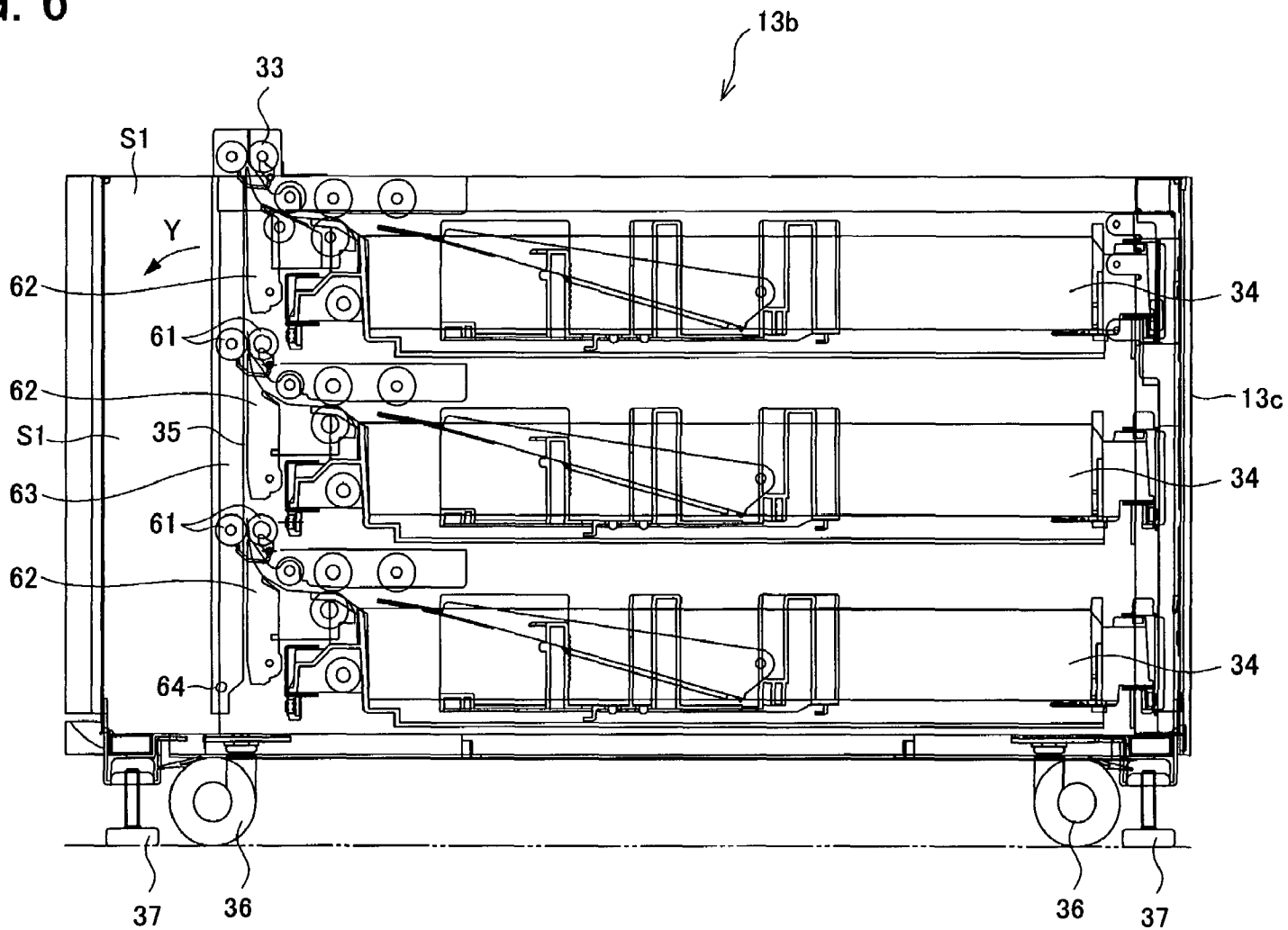
FIG. 6 is a cross-sectional view illustrating the structure of a recording material supply device of the image forming apparatus.
Figure 7:
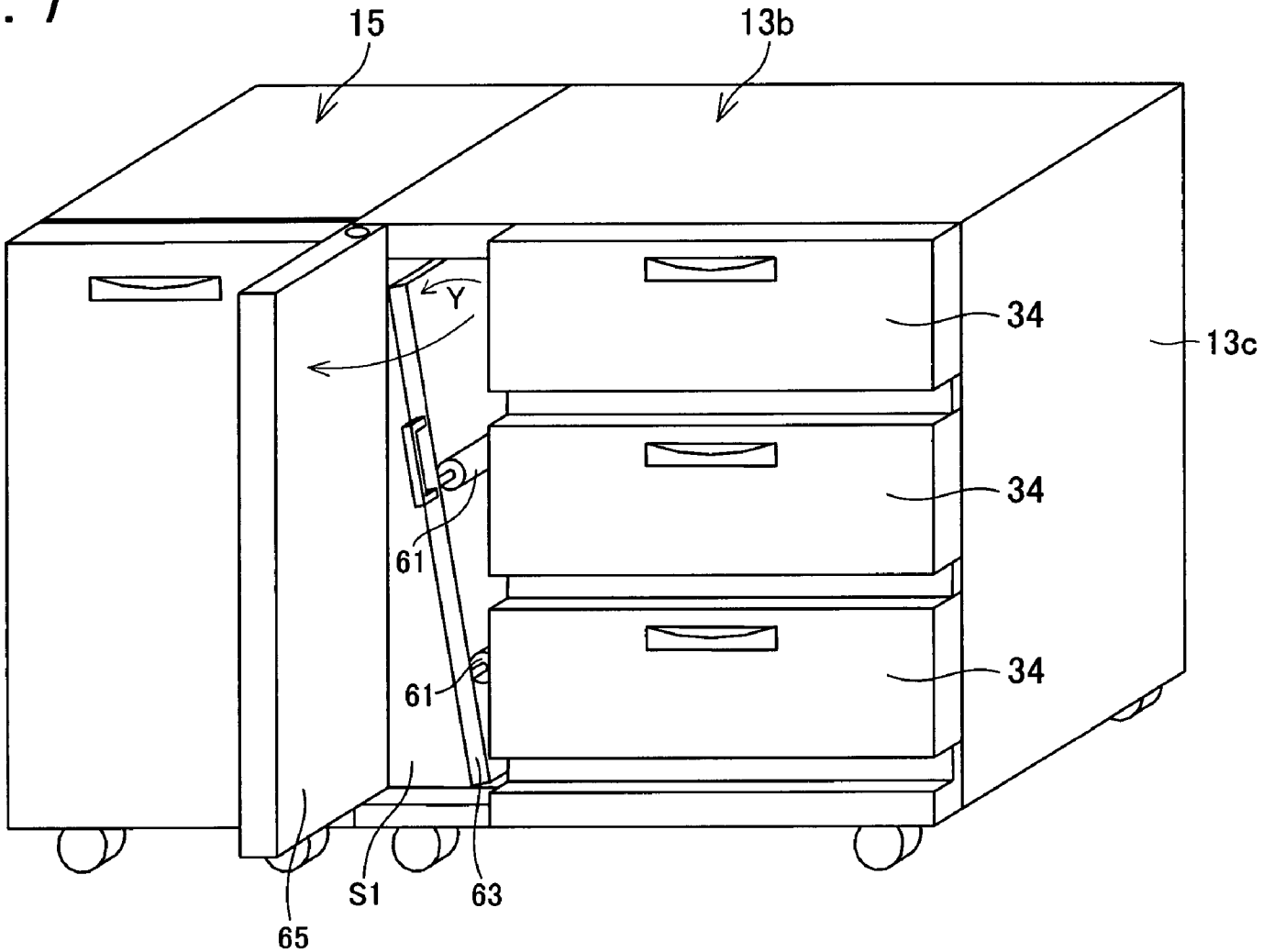
FIG. 7 is a front view illustrating the structure of essential parts of the image forming system.

FIG. 6 is a cross-sectional view illustrating the structure of the recording material supply device 13*b* as an expanded unit. The recording material supply device 13*b* has a multi-layered recording material storage tray 34. In the case where the recording material supply unit 13*a* cannot store a sufficient amount of the recording material, etc., the recording material supply device 13*b* can be added as a part of the image forming apparatus 10 as an optional device. Incidentally, the recording material storage tray 34 is not necessarily be multi-layered, and may be, for example, a single-layered tray, designed to store the recording material in size different from the recording material stored in the recording material storage tray 30 in the recording material supply unit 13*a*. The recording material supply device 13*b* may be arranged so as to store the recording material which is larger in size than those stored in the recording material storage tray 30 of the recording material supply unit 13*a*.

As illustrated in FIG. 6, the recording material supply device 13*b* is provided with a multi-level recording material storage tray 34 (triple-layered in the example shown in FIG. 3). From the multi-level recording material storage tray 34, the recording material storage tray storing the desired recording material is selectively operated so as to separately transport the recording material stored in the recording material storage tray 34. The recording material storage tray 34 can be operated selectively under the control by the process control unit (PCU), etc., provided in the control section 41 of the image recording device 12.

The recording material supply device 13*b* is provided with the longitudinal transport path (recording material supply path) for supplying the recording material substantially in the vertical direction from the recording material supply device 13*b* to the image recording device 12. A longitudinal transport path 35 is provided in the recording material supply device 13*b* in the lateral direction along the left side wall inside a recording material supply device main body 13*c* which constitutes the recording material supply device 13*b* adjacent to each recording material storage tray 34. The longitudinal transport path 35 is regulated by a plurality of rollers (transport rollers) 61 and guides 62 and 63 provided in parallel in the longitudinal direction within the recording material supply device 13*b*.

Further, on the downstream side of the longitudinal transport path 35, a recording material discharge section 33 is provided on the upper surface of the recording material supply device 13*b*. The longitudinal transport path 35 is used as a common transport path for the recording material discharged from each recording material storage tray 34. This longitudinal transport path 35 is provided for separately transporting the recording material stored in the recording material storage tray 34 one by one to the recording material discharge section 33.

As a result, the recording material separately transported from the multi-layered recording material storage tray 34 is carried via the recording material storage tray 34 to the recording material receiving section 32*a* provided in the lower part of the image recording device 12 from the recording material discharge section 33 provided on the upper surface of the recording material supply device 13*b*, and is then transported to the electro-photographic processing section.

On the left side of the longitudinal transport path 35 in the recording material supply device 13*b*, a space S1 is ensured for opening the longitudinal transport path 35.

This space S1 is provided so that in an event that the recording material separately transported from each section of the multi-layered recording material storage tray 34 is stuck in the longitudinal transport path 35 which extends in the longitudinal direction while being transported separately, the operation of removing the recording material (Jammed recording material removing process) as stuck can be performed by opening the longitudinal transport path 35. Therefore, the space should have enough space for opening the longitudinal transport path 35 to the outside for the jammed recording material removing process.

The longitudinal transport path 35 can be divided in the longitudinal direction, and is arranged such that a guide 63 on the left side face of the longitudinal transport path 35, i.e., the side wall facing the side facing the inner side wall of the recording material supply device main body 13*c* in the longitudinal transport path 35 is supported so as to be rotatable about an axis 64 provided under the longitudinal transport path 35. As a result, the recording material supply device 13*b* is arranged such that in the case of removing the recording material stuck in the longitudinal transport path 35 or opening the longitudinal transport path 35, the guide 63 on the left side face of the longitudinal transport path 35 is opened in the direction of an arrow Y about the axis 74 as a fulcrum (point of support for rotating movement) to be inclined from the position shown in FIG. 6 to the position shown in FIG. 7, so as to open the longitudinal transport path 35.

On the front side (operating side) of the recording material supply device 13*b*, provided is a cover 65 as an opening door for opening the space S1 and the longitudinal transport path 35 for the jammed recording material removing process. As a result, in such event that a recording material is jammed in the longitudinal transport path 35, the user can confirm the recording material in the state where the longitudinal transport path 35 is opened in the direction of an arrow Y by opening the cover 65, and can then remove the recording material as stuck.

The longitudinal transport path 35 is provided so as to be apart from the inner side wall of the recording material supply device main body 13*c* so that the recording material supply device main body 13*c* has the space S1, which permits the recording material supply device 13*b* to open from the front side of the recording material supply device 13*b*, between the inner side wall of the recording material supply device main body 13*c* and the longitudinal transport path 35. In other words, the recording material supply device 13*b* in the image forming apparatus 10 of the present embodiment is arranged such that recording material supply device main body 13*c* (the main body of the image forming apparatus 10), i.e., the cabinet which constitutes the recording material supply device 13*b* (image forming apparatus 10) has the above space S1.

The recording material supply device 13*b* is arranged such that the recording material storage tray 34 can be drawn to the front face side of the recording material supply device 13*b*, i.e., to the near side (front side). In the case of setting (supplying or exchanging) the recording material to the recording material supply device 13*b*, the recording material storage tray 34 is drawn to the front side of the recording material supply device 13*b*. With this structure, the image forming apparatus 10 can perform all the processes including the process of removing the recording material stuck in the longitudinal transport path 35, supplying/exchanging the recording material, etc., from the front side of the image forming apparatus 10. Therefore, it is not necessary to ensure the space for setting the recording material nor performing the jammed recording material removing process. As a result, the required space for placing the apparatus and the operation space can be reduced, and the space for the installation of the apparatus can be ensured with ease. With the foregoing structure, it is possible to provide an image forming system, which shows excellent operation efficiency for setting the recording material or carrying out the jammed recording material removing process even in the structure wherein a peripheral equipment such as the external recording material supply device 15, for example, is connected to the side face of the image forming apparatus 10 as illustrated in FIG. 1.

As illustrated in FIG. 1, the image forming apparatus 10 is provided with the both-sided printing transport unit 21 on the opposite side of the electro-photographic processing section in the recording material transport section 17, i.e., along the side wall in the image recording device main body 12*a* (main body of the image forming apparatus 10) on the side the external recording material supply unit 15 is provided), and the space S1 for opening the longitudinal transport path 35 is formed below the both-sided printing transport unit 21. With this structure, the required space for the image forming apparatus 10 can be reduced, which in turns reduces the required space for the image forming system 1 itself. In the present embodiment, the space Si is provided utilizing the space below the both-sided printing transport unit 21. Therefore, on appearance, the image forming apparatus 10 has a flat side face irrespectively of differences in size of respective devices (sections) which constitute the image forming apparatus 10, which in turn realizes a simple and neat appearance of the image forming system itself. With this structure, it is possible to combine the peripheral equipment with the image forming apparatus 10 with ease, and sense of beauty can be ensured without adversely affecting office environment.

As illustrated in FIG. 6, a plurality of wheels 36 are provided under the lower surface of the recording material supply device 13*b* which allow the image forming apparatus 10 including the recording material supply device 13*b* to move with ease. Below the lower surface of the recording material supply device 13*b*, a stopper 37 is provided, which permits the recording material supply device 13*b* to be fixed at the place of installation.

Next, the external recording material supply unit 15 provided in parallel with the image forming apparatus 10 will be explained.

Figure 8:
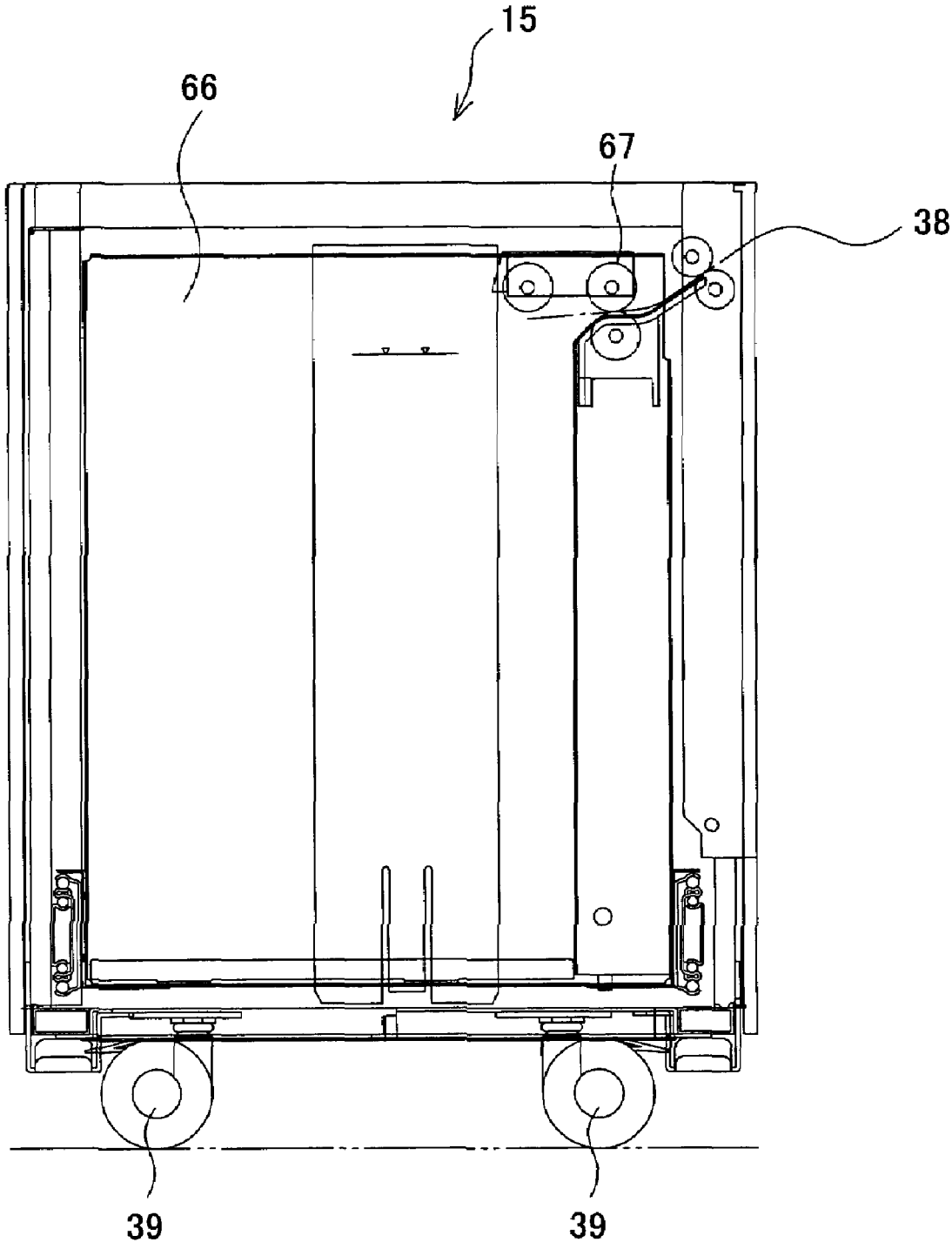
FIG. 8 is a cross-sectional view illustrating the structure of an external recording material supply device.

FIG. 8 is a cross-sectional view illustrating the structure of the external recording material supply unit 15. To enable high speed and large volume printing, the external recording material supply unit 15 is provided. Specifically, the external recording material supply unit 15 is arranged so as to be capable of storing at once the recording material of more variety of kinds and in larger volume than the recording material supply unit 13*a* and the recording material supply device 13*b* of the image forming apparatus 10. The external recording material supply unit 15 has a recording material storage section (expanded recording material storage section) 66.

Furthermore, the external recording material supply unit 15 includes pickup rollers 67 and a recording material discharge section 38, etc., in the right upper part, and the recording material stored in the recording material storage section 66 is separately discharged to the recording material discharge section 38 one by one by the pickup rollers 67, etc.

The recording material transported from the recording material discharge section 38 is carried to an expanded recording material receiving section 32*b* provided in the left lower part of the image recording device 12.

Here, the shorter is the recording material supply path from the external recording material supply unit 15 to the electro-photographic processing section, the more desirable. In the image forming system 1 in accordance with the present embodiment, the position of the recording material discharge section 38 is selected such that the recording material discharge section 38 of the external recording material supply unit 15 is positioned, near the recording material discharge section 33 of the recording material supply device 13*b*.

Figure 10:
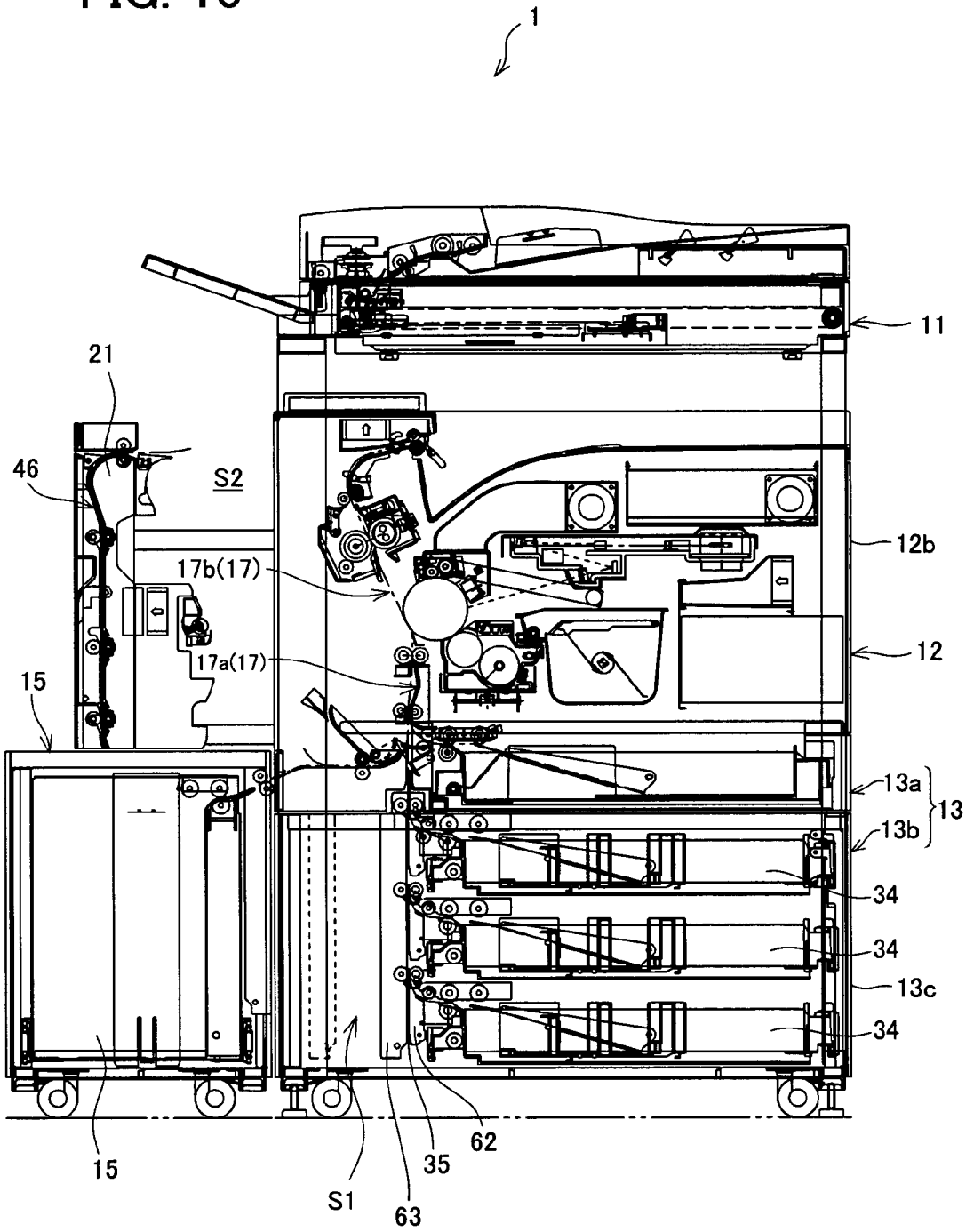
FIG. 10 is a cross-sectional view of the image forming system in the state where a recording material transport path of the image recording device of FIG. 4 is open.
Figure 11:
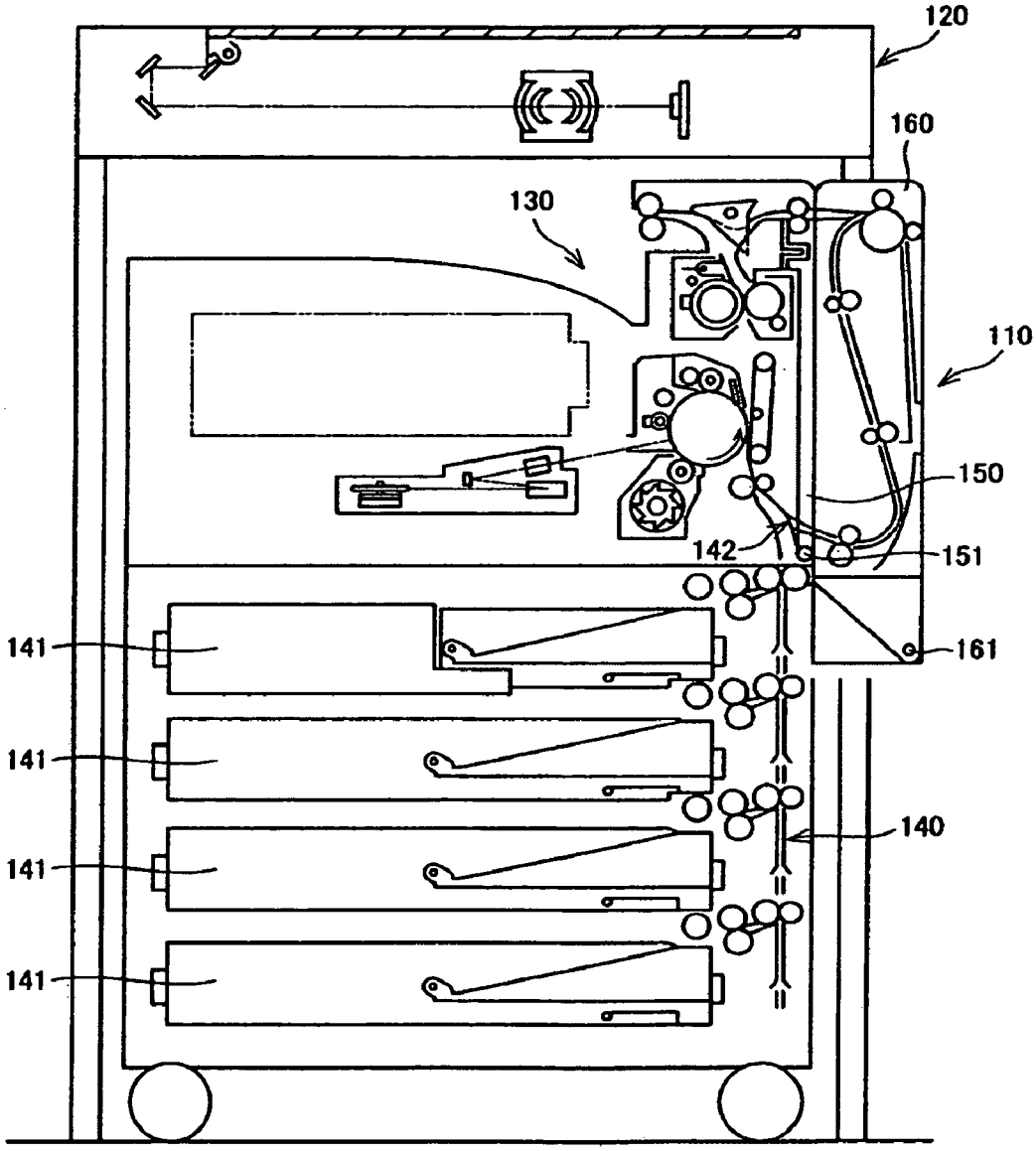
FIG. 11 Prior Art
FIG. 11 is a cross-sectional view illustrating the structure of a conventional image forming apparatus of Japanese Unexamined Patent Application No. 9-297440/1997.
Figure 12:
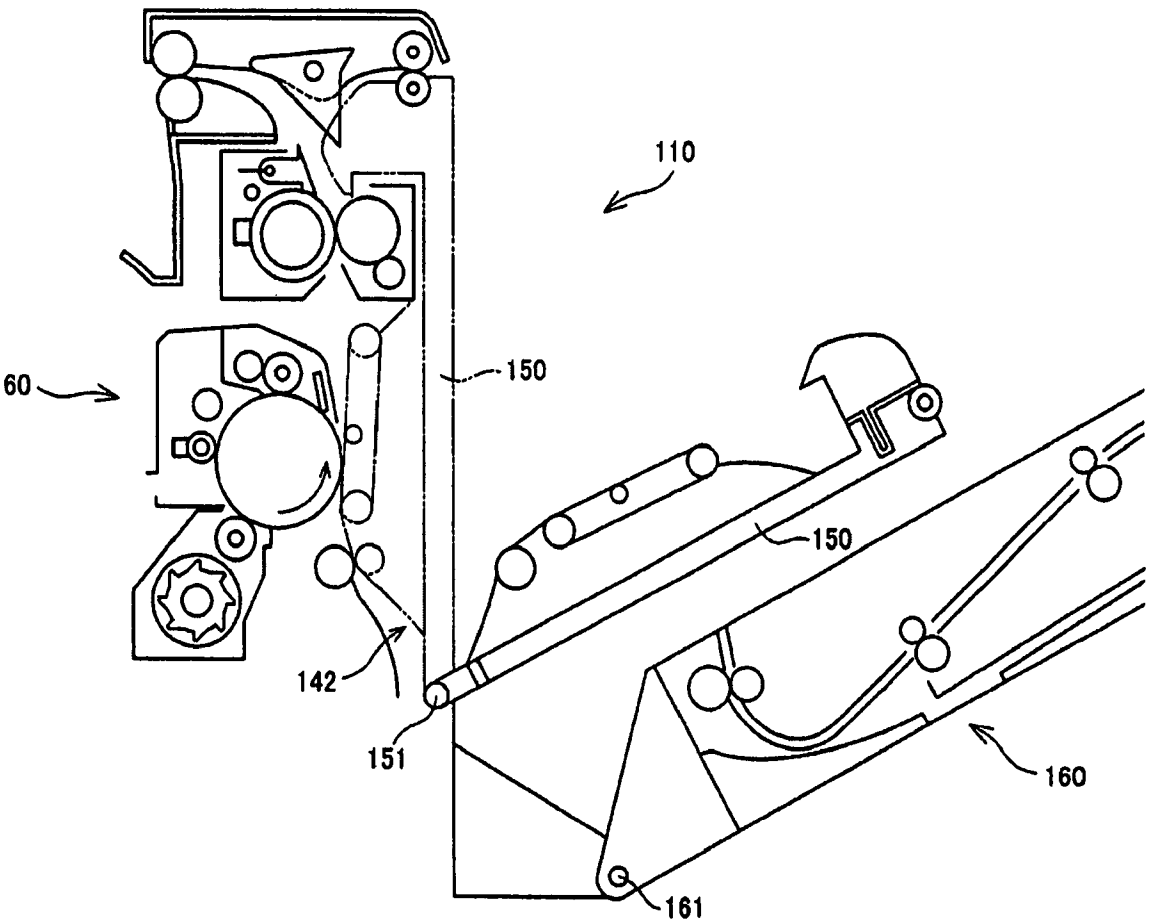
FIG. 12 Prior Art
FIG. 12 is a cross-sectional view illustrating the structure of essential parts of the image forming apparatus of FIG. 11.
Figure 13:
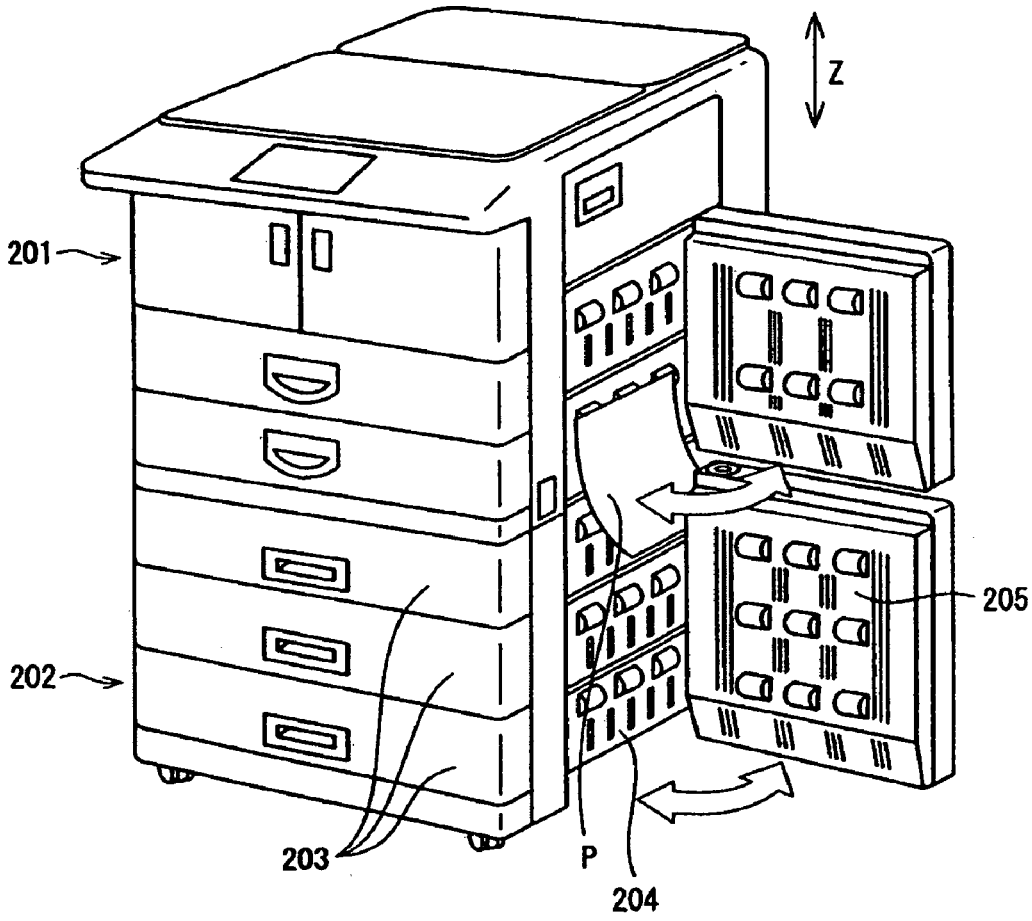
FIG. 13 Prior Art
FIG. 13 is a cross-sectional view illustrating the structure of a conventional image forming apparatus of Japanese Unexamined Patent Application No. 7-301964/1995.

As a result, in an event that a paper is stuck in the recording material transport path from the external recording material supply unit 15 to the electro-photographic processing section, as illustrated in FIG. 10, for example, a predetermined unit including the both-sided printing transport section of the both-sided printing transport unit 21 is drawn towards the side of the external recording material supply unit 15 so as to open the recording material transport section 17 of the image recording device 12, and then open the recording material supply unit 13*a* utilizing the resulting space, thereby permitting a process of removing the jammed recording material.

The recording material storage section 66 can be drawn to the front side of the external recording material supply unit 15, i.e., to the near side (front face side). With this structure, when setting the recording material (supplying or exchanging) with respect to the external recording material supply unit 15, the recording material storage section 66 is drawn to the front side of the external recording material supply unit 15 to set the recording material. As a result, the image forming system 1 permits a user to perform not only the operations with respect to the image forming apparatus 10 but also the operation with respect to the external recording material supply unit 15 from the front side of the image forming system 1, thereby achieving a still improved operability. In the meantime, it is not necessary to separately ensure the space for supplying or exchanging the recording material with respect to the external recording material supply unit 15, and the recording material can be supplied or discharged with respect to the external recording material supply unit 15 within a predetermined width of the image forming system 1. As a result, the installation space and the operation space can be reduced, and the performance can be improved with a minimum increase in the required installation space, whereby the installation space can be ensured with ease.

A plurality of wheels 39 are provided under the lower surface of the external recording material supply device 15 which allow the external recording material supply unit 15 to move with ease. Here, although not shown, by providing a similar stopper to the stopper 37 provided on the image forming apparatus 10, it may be arranged such that the external recording material supply unit 15 can be fixed to the installation place using the stopper.

As illustrated in FIG. 10, the height for the upper surface of the external recording material supply unit 15 is restricted such that in an event of a jammed recording material, a predetermined unit including the both-sided printing transport section of the both-sided printing transport unit 21 can be drawn from the image forming apparatus 10 to the external recording material supply unit 15 at above the external recording material supply unit 15. With this structure, in the image forming system 1, as illustrated in FIG. 9 and FIG. 10, the space S2 is ensured beforehand for opening the re-transport path 46 or the recording material transport section 17 to the left side of the both-sided printing transport unit 21 as illustrated in FIG. 9 or FIG. 10.

Next, the operation of the image forming system 1 will be explained.

First, the image data is obtained by reading the document by the document image reading device 11, and the resulting image data is output to the image recording apparatus 12. The image recording device 12 performs an appropriate image process to the input image data.

Based on an instruction given by the user, from the recording material supply section 13 or the external recording material supply unit 15, a sheet-like recording material such as a print sheet or an OHP (Over Head Projector) sheet, etc., is separately transported one by one to be conveyed to the image recording device 12 by the first transport path 17*a* of the recording material transport section 17.

The image forming system 1 is arranged such that the external recording material supply unit 15 is connected to the image forming apparatus 10 as a peripheral equipment for expanding functions, and by storing the recording material of the kinds and volume as desired in the external recording material supply unit 15, it is possible to supply a larger kinds and greater amount of the recording material than those stored in the recording material supply section 13.

The image recording apparatus 12 is arranged so as to form an image based on the image data onto the recording material by printing, etc. The recording material having an image formed thereon is transported to the recording material discharge section 16 by the second re-transport path 17*b* of the recording material transport section 17 and is then discharged to the outside of the external recording material supply unit 15.

The document image reading device 11 is provided with the document tray 18 as a document supply section and the discharge tray 19 (document collecting section). In the case of supplying a document, a document of plural pages is placed on a document tray 18, and the document placed on the document tray 18 is separated one by one to be transported to a reading section sequentially. Then, the document as passed through the reading section is received and stored in the discharge tray 19.

The document image as read sequentially is discharged as a printing having a document image printed thereon to the recording material discharge section 16.

Incidentally, for energy saving (environmental conservation) and cost reduction, in the case of using a print material, etc., as the recording material, the image forming apparatus 10 is required to have a function of printing images on both sides of the recording material. As explained earlier, this function can be realized by the both-sided printing transport unit 21 for transporting the recording material having the image formed on one side is reversed and is transported to the electro-photographic printing section of the image recording device 12. The recording material having an image printed on one side is revered by the both-sided printing transport unit 21 without being transported to the recording material discharge section 16 or the post-processing device (not shown), to be transported again to the electro-photographic printing section of the image recording device 12. The image recording device 12 performs a both-sided printing by printing an image on the side without having formed thereon an image. The recording material having gone through the print process is either discharged from the recording material discharge section 16 or transported to the post-processing device (not shown). In the case of selecting the post-processing mode, the post process after printing as specified is performed.

The process of removing the jammed recording material in an event of a paper jam in the image forming system 1 will be explained.

In an event that a paper jam occurs in the longitudinal transport path 35, the user first opens the cover (door) 65 provided on the front side (near side) of the recording material supply device 13*b*. Next, the existence of the recording material is confirmed in the state where the longitudinal transport path 35 is opened, and the recording material as stuck is then removed. After removing the recording material, the longitudinal transport path 35 as opened is moved back to the operable state in which transportation of a recording material is permitted, and the cover 65 provided on the front side (near side) of the recording material supply device 13*b* is closed, thereby completing the process.

As described, according to the image forming system 1 in accordance with the present embodiment, the recording material supply device main body 13*c* has the space S1 between the inner side wall of the recording material supply device main body 13*c* and the longitudinal transport path 35, for opening the recording material supply device 13*b* from the front side of the recording material supply device 13*b*. With this structure, an opening for opening the longitudinal transport path 35 can be performed using the space S1 ensured on the left side of the longitudinal transport path 35.

As illustrated in FIG. 1, according to the environment of use in the installation place (or as desired by the user), the external recording material supply unit 15 can be added to the left side of the recording material supply device 13*b*, i.e., on the side where the recording material transport path such as the recording material transport section 17, the longitudinal transport path 35, or the re-transport path 46, etc., are formed. The foregoing structure is selected to reduce the length of the recording material transport path from the external recording material supply unit 15 to the electrophotographic processing section to the minimum to suppress an occurrence of an inferior in supplying the recording material in its transportation.

When adding this external recording material supply unit 15, however, the left side face of the recording material supply device 13*b* is covered with the external recording material supply unit 15. Therefore, with the structure wherein the opening cover for opening the longitudinal transport path 35 is provided on the left side face of the recording material supply device main body 13*c* and the door is opened so as to open the longitudinal transport path 35, each time paper jam occurs in the longitudinal transport path 35, it is necessary to move the external recording material supply unit 15. With the foregoing structure, it is therefore necessary to install the image forming apparatus 10 and the external recording material supply unit 15 in consideration of the operation space, and a suitable installation place is thereby limited.

According to the present embodiment, however, the process of opening the longitudinal transport path 35 can be performed using the space S1, and it is therefore possible to perform the process of removing the jammed recording material without moving the external recording material supply unit 15. According to the structure of the present embodiment, an improved operation efficiency for removing the jammed recording material can be achieved. In the meantime, the image forming system 1 can be installed without considering the space for the operation of removing the jammed recording material, and the installation space and the operation space can be reduced. As a result, the installation space can be ensured with ease.

According to the image forming system 1, in the stage of installing the image recording device 12 and the recording material supply device 13*b*, the space (operation space) S2 is ensured beforehand for opening for the performing a necessary operation on the left side of the both-sided printing transport device 21.

According to the present embodiment, even when the recording material is stuck in the recording material transport section 17 or the re-transport path 46 of the image recording device 12, as illustrated in FIG. 9 or FIG. 10, the recording material can be removed by opening the left side face of the image recording device 12 or the both-sided printing transport unit 21 without moving the external recording material supply unit 15. Therefore, with the foregoing structure, the operation of removing the recording material as stuck in the recording material transport section 17 or the re-transport path 46 can be performed within the range for the width of the installation place of the image forming system 1. Further, the recording material transport section 17 and the re-transport path 46 can be opened using the minimum installation space, and the external recording material supply unit 15 can be added with a minimum installation space. Here, FIG. 9 illustrates the state where the re-transport path 46 of the both-sided printing transport unit 21 is open to the space S2, and FIG. 10 illustrates the state where the recording material transport section 17 of the image recording device 12 is open to the space S2.

According to the present embodiment, explanations of a peripheral equipment of the image forming apparatus 10 have been given through the case of adopting a large volume external section recording material supply device 15 externally mounted to the image forming apparatus 10. The present invention, however, is not intended to be limited to the foregoing, and the present invention is applicable to any of the image forming systems provided with a peripheral equipment to be connected in parallel with one of the side faces of the image forming apparatus 10. According to the present embodiment, irrespectively of the peripheral equipment, it is possible to perform the process of removing the jammed recording material without moving the peripheral equipment. As a result, it is possible to provide an image forming system, which shows an excellent operation efficiency for removing the jammed recording material while suppressing the installation space for the peripheral equipment and the operation space of the jammed process.

For example, as the peripheral equipment, for example, a device which performs a predetermine process with respect to the recording material having an image formed thereon as transported from the image forming apparatus 10 may be adopted. Examples of such device include the foregoing post processing device, or the external recording material supply unit 15 which may be provided alone or in combination to form a system unit.

In the foregoing preferred embodiment, explanations have been given through the case where the external recording material supply unit 15 is provided with the large volume recording material storage section 66 which can be drawn to the front side of the external recording material supply unit 15. The structure of the external recording material supply unit 15 of the present invention, however, is not intended to be limited to the foregoing structure, and the external recording material supply unit 15 may be arranged so as to be provided with a plurality of recording material storage trays which can be drawn to the front face side of the external recording material supply unit 15.

In the foregoing preferred embodiment, explanations have been given through the case where only one recording material storage tray 30 is provided in the image recording apparatus 12. However, the present invention is not intended to be limited to the foregoing structure, and, for example, the structure without the recording material storage tray 30 in the image recording apparatus wherein the recording material is supplied from the recording material supply device 13*b* as an expanded unit may be equally adopted. On the other hand, the structure wherein two or more recording material storage trays 30 are provided in the inside of the image recording apparatus 12 may be adopted.

As described, the image forming apparatus in accordance with the present embodiment is, for example, arranged so as to include: an image recording device which is made up of an image forming section for forming an image on a recording material and a recording material transport path for transporting the recording material from the recording material supply section towards the recording material discharge section via the image forming section; and a recording material supply device which is made up of at least one recording material supply section and a recording material supply path (longitudinal transport path) for supplying the recording material towards the image recording device, wherein the recording material supply device has an operation space which permits the recording material supply path to open from the near side of the apparatus.

With this structure, by operating from the near side to open the recording material transport path, a necessary process for solving the trouble can be performed within the installation space of the apparatus.

According to the image forming system, the image recording apparatus can be connected (mounted) within the installation space for the recording material supply device having the above operation space.

As a result, the installation space can be minimized, and the installed apparatus offers a neat appearance, without destroying office environment of the installation place.

The foregoing image forming system may be further arranged such that the image recording device is provided with the recording material re-transport path for supplying a recording material having an image recorded thereon to an image forming section on a different side from the image forming section of the recording material transport path.

According to the foregoing structure, the operation space which opens the transport path is formed below the re-transport path formed along the side face of the image recording apparatus. As a result, the installed apparatus offers a neat appearance, without destroying office environment of the installation place.

The foregoing image forming apparatus may be arranged such that a new recording material supply device is connected so as to sandwich an operation space of the recording material supply device.

According to the foregoing structure, it is possible to perform a recording job of a large volume. Furthermore, since two recording material supply devices are provided so as to sandwich the operation space in between, even when the recording material is stuck in the recording material supply path in one of the recording material supply device, the other recording material supply device can be operated without problem.

The foregoing new recording material supply device may be arranged such that the recording material storage section can be drawn to the near side.

With this structure, the operation of supplying the recording material to the recording material supply device can be performed within the width of the installation space of the image forming system.

The foregoing image forming system may be further arranged such that in the image recording apparatus, the side face of the apparatus main body is open at above the newly connected recording material supply device.

According to the foregoing structure, it is possible to remove the recording material as stuck in the recording material transport path of the image recording device within the width of the installation space of the image forming system.

The structure o the present invention is not intended to be limited to the foregoing structure, and is applicable to any of the structure wherein a recording material transport path (recording material supply path) which extends in a longitudinal direction along the side face of the main body of the image forming apparatus in the main body and a peripheral equipment integrally provided with the external section of the main body of the image forming apparatus are provided so as to sandwich the space.

As described, the image forming apparatus of the present invention is characterized by including:

a recording material supply path for supplying a recording material in a substantially vertical direction from a recording material storage section towards an image forming section for forming an image on the recording material, wherein the recording material transport path is provided in the image forming apparatus along one of side walls of a main body of the image forming apparatus;

the main body of the image forming apparatus has a space which allows the recording material supply path to open from a front side of the image forming apparatus, the space being formed between an inner wall on a side of the recording material supply path and the recording material supply path; and the space is formed in sufficient size to allow the recording material supply path to open in such a manner that an operation of removing the recording material stuck in the recording material supply path can be performed.

According to the foregoing structure, the process of removing the recording material as stuck in the recording material supply path can be performed from the front side of the image forming apparatus. In the meantime, the image forming system can be installed without considering the space for the operation of removing the jammed recording material, and the installation space and the operation space can be reduced. Thus, the installation space can be ensured with ease. With the foregoing structure, it is therefore possible to perform various operations as desired even when the image forming apparatus is installed at a corner of the room.

The image forming system of the present invention is characterized by including:

an image forming apparatus which includes:

a recording material supply path (a longitudinal transport path, for example) for supplying a recording material in a substantially vertical direction from a recording material storage section (a recording material supply device, for example) towards an image forming section (an image recording device, for example) for forming an image on the recording material, wherein the recording material transport path is provided in the image forming apparatus along one of side walls of a main body of the image forming apparatus; and a peripheral equipment (an external recording material supply device of a large volume supply unit, example) to be connected to the image forming apparatus in parallel to the side wall on a side of the recording material supply path in the main body of the image forming apparatus, and wherein the main body of the image forming apparatus (a main body of the recording material supply device, for example) has a space which allows the recording material supply path to open from a front side of the image forming apparatus, the space being formed between an inner side wall on a connecting side of the peripheral equipment and the recording material supply path.

In order to achieve the above object, another image forming apparatus connectable to a peripheral equipment, is characterized by including:

a recording material supply path for supplying a recording material in a substantially vertical direction from a recording material storage section towards an image forming section for forming an image on the recording material, wherein the recording material transport path is provided in the image forming apparatus along one of side walls of a main body of the image forming apparatus; and the main body of the image forming apparatus has a space which allows the recording material supply path to open from a front side of the image forming apparatus, the space being formed between an inner side wall on a peripheral equipment connecting side and the recording material supply path.

According to the foregoing structure, an operation of opening the recording material supply path can be performed using the space formed in the main body, and it is therefore possible to perform the process of removing a jammed recording material without moving the peripheral equipment. As a result, the process of removing the jammed recording material can be performed with an improved efficiency. In the meantime, the image forming system can be installed without considering the space for the operation of removing the jammed recording material, and the installation space and the operation space can be reduced. Thus, the installation space can be ensured with ease. As a result, it is possible to provide an image forming system which shows excellent operation efficiency for removing a jammed recording material while reducing the installation space for the peripheral equipment and the required space for removing the jammed recording material.

It is desirable that the foregoing image forming system be further arranged so as to include a recording material re-transport path for reversing a recording material having formed thereon an image and transporting the recording material again to the image forming section; and the recording material supply path and the recording material re-transport path are provided in such a manner that the space is formed below the recording material re-transport path in the main body of the image forming apparatus.

According to the foregoing structure, the above space can be formed using a space formed under the recording material re-transport path can be used for the space. It is therefore possible to minimize the installation space for the image forming apparatus, which, in turn, minimizes the installation space for the image forming system. In the meantime, a simple and neat design for the image forming apparatus can be realized, which in turn realizes an overall image forming system of simple and neat design.

It is preferable that the foregoing image forming system be further arranged such that the recording material re-transport path be provided along an inner side wall of the main body of the image forming apparatus on a side of the recording material supply path, and the recording material re-transport path can be opened at above the peripheral equipment.

According to the foregoing structure, it is possible to remove the recording material as stuck in the recording material re-transport path within the range for the width of the installation place of the image forming system. In the meantime, it is possible to install the peripheral equipment with a minimum installation space and to open the recording material re-transport path, etc.

It is also preferable that the foregoing image forming system be arranged such that:

the peripheral equipment is a recording material supply device for supplying a recording material from outside the image forming apparatus to the image forming section; and the recording material supply device (an external recording material supply device such as a large volume feeder unit, for example) has an expanded recording material storage section which can be drawn to a front side.

According to the foregoing structure, it is not necessarily to ensure the space for supplying and exchanging the recording material with respect to the recording material supply device, and the recording material can be supplied to the recording material supply device or exchanged from those stored in the recording material supply device within a predetermined width of the image forming apparatus. It is therefore possible to minimize the installation space and the operation space. In the meantime, it is possible to expand the functions of the apparatus while suppressing the required space for installation of the peripheral equipment, and thus the installation space can be ensured with ease. Furthermore, the foregoing operation can be performed from the front side of the image forming system, and thus a still improved operability can be achieved.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming system, comprising:

an image forming apparatus which includes:

a recording material supply path for supplying a recording material in a substantially vertical direction from a recording material storage section towards an image forming section for forming an image on the recording material, wherein said recording material supply path is provided in said image forming apparatus along one of side walls of a main body of said image forming apparatus; and a peripheral equipment to be connected to said image forming apparatus in parallel to the side wall on a side of said recording material supply path in said main body of said image forming apparatus, said main body of said image forming apparatus has a space which allows said recording material supply path to open from a front side of said image forming apparatus, said space being formed between an inner side wall on a side of connecting said peripheral equipment and said recording material supply path.

2. The image forming system as set forth in claim 1, wherein:

said space is formed in sufficient size to allow said recording material supply path to open in such a manner that an operation of removing said recording material stuck in said recording material supply path can be performed.

3. The image forming system as set forth in claim 2, wherein:

said main body of said image forming apparatus has a cover on a front side of said main body of said image forming apparatus, which opens and closes said space as desired.

4. The image forming system as set forth in claim 1, wherein:

said recording material supply path includes a guide section which forms said space; and said guide section is supported so as to be rotatable about an axis provided at a bottom end of said recording material supply path, so that said guide section can be moved to the space.

5. The image forming system as set forth in claim 1, wherein:

said image forming apparatus includes a recording material re-transport path for reversing a recording material having formed thereon an image and transporting said recording material again to said image forming section; and said recording material supply path and said recording material re-transport path are provided in such a manner that said space is formed below said recording material re-transport path in said main body of said image forming apparatus.

6. The image forming system as set forth in claim 5, wherein a height of an upper surface of said peripheral equipment is selected so as to allow a predetermined unit of said image forming apparatus to draw at above said peripheral equipment.

7. The image forming apparatus as set forth in claim 6, wherein:

said predetermined unit includes a both-sided printing transport device which has said recording material re-transport path.

8. The image forming system as set forth in claim 5, wherein:

said recording material re-transport path is provided along an inner side wall of said main body of said image forming apparatus on a side of said recording material supply path, and said recording material re-transport path can be opened at above said peripheral equipment.

9. The image forming system as set forth in claim 1, wherein:

said peripheral equipment is a recording material supply device for supplying a recording material from outside said image forming apparatus to said image forming section; and said recording material supply device has an expanded recording material storage section which can be drawn to a front side.

10. The image forming system as set forth in claim 9, wherein:

said recording material supply section can be drawn to a front side; and not only an operation of said image forming apparatus but also an operation of said peripheral equipment can be performed from a front side of said image forming system.

11. An image forming apparatus connectable to a peripheral equipment, comprising:

a recording material supply path for supplying a recording material in a substantially vertical direction from a recording material storage section towards an image forming section for forming an image on the recording material, wherein said recording material supply path is provided in said image forming apparatus along one of side walls of a main body of said image forming apparatus; and said main body of said image forming apparatus has a space which allows said recording material supply path to open from a front side of said image forming apparatus, said space being formed between an inner side wall on a peripheral equipment connecting side and said recording material supply path.

12. The image forming apparatus as set forth in claim 11, wherein:

said space is formed in sufficient size to allow said recording material supply path to open in such a manner that an operation of removing said recording material stuck in said recording material supply path can be performed.

13. The image forming apparatus as set forth in claim 11, wherein:

said recording material supply path includes a guide section which forms said space; and said guide section is supported so as to be rotatable about an axis provided at a bottom end of said recording material supply path, so that said guide section can be moved to the space.

14. The image forming apparatus as set forth in claim 12, wherein:

said main body of said image forming apparatus has a cover on a front side of said main body of said image forming apparatus, which opens and closes said space as desired.

15. The image forming apparatus as set forth in claim 11, wherein:

said image forming apparatus includes a recording material re-transport path for reversing a recording material having formed thereon an image and transporting said recording material again to said image forming section; and said recording material supply path and said recording material re-transport path are provided in such a manner that said space is formed below said recording material re-transport path in said main body of said image forming apparatus.

16. An image forming apparatus, comprising:

a recording material supply path for supplying a recording material in a substantially vertical direction from a recording material storage section towards an image forming section for forming an image on the recording material, wherein said recording material supply path is provided in said image forming apparatus along one of side walls of a main body of said image forming apparatus;

said main body of said image forming apparatus has a space which allows said recording material supply path to open from a front side of said image forming apparatus, said space being formed between an inner wall on a side of said recording material supply path and said recording material supply path; and said space is formed in sufficient size to allow said recording material supply path to open in such a manner that an operation of removing said recording material stuck in said recording material supply path can be performed.

17. The image forming apparatus as set forth in claim 16, wherein:

said recording material supply path includes a guide section which forms said space; and said guide section is supported so as to be rotatable about an axis provided at a bottom end of said recording material supply path, so that said guide section can be moved to the space.

18. The image forming apparatus as set forth in claim 17, wherein:

said main body of said image forming apparatus main body has a cover on a front side of said main body of said image forming apparatus, which opens and closes said space as desired.

19. The image forming apparatus as set forth in claim 16, wherein:

said image forming apparatus includes a recording material re-transport path for reversing a recording material having formed thereon an image and transporting said recording material again to said image forming section; and said recording material supply path and said recording material re-transport path are provided in such a manner that said space is formed below said recording material re-transport path in said main body of said image forming apparatus.

* * * * *